US011466337B2

(12) United States Patent
Natsumeda et al.

(10) Patent No.: US 11,466,337 B2
(45) **Date of Patent: *Oct. 11, 2022**

(54) HIGH-STRENGTH STEEL SHEET AND METHOD FOR PRODUCING SAME

(71) Applicant: Kobe Steel, Ltd., Kobe (JP)

(72) Inventors: Hirokazu Natsumeda, Kobe (JP); Toshio Murakami, Kobe (JP); Kenji Saito, Kakogawa (JP); Tadao Murata, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 166 days.

This patent is subject to a terminal disclaimer.

(21) Appl. No.: 16/617,736

(22) PCT Filed: May 22, 2018

(86) PCT No.: PCT/JP2018/019594
§ 371 (c)(1),
(2) Date: Nov. 27, 2019

(87) PCT Pub. No.: WO2018/221307
PCT Pub. Date: Dec. 6, 2018

(65) Prior Publication Data

US 2020/0190619 A1 Jun. 18, 2020

(30) Foreign Application Priority Data

May 31, 2017 (JP) ..... JP2017-108340

(51) Int. Cl.
*B32B 15/00* (2006.01)
*C21D 9/46* (2006.01)
(Continued)

(52) U.S. Cl.
CPC ..... *C21D 9/46* (2013.01); *C21D 6/005* (2013.01); *C21D 6/008* (2013.01); *C21D 8/0205* (2013.01);
(Continued)

(58) Field of Classification Search
CPC ..... C21D 6/00; C21D 6/005; C21D 6/008; C21D 8/02; C21D 8/0205; C21D 8/0226;
(Continued)

(56) References Cited

U.S. PATENT DOCUMENTS

2004/0226635 A1* 11/2004 Ikeda ..... C22C 38/06 148/649
2011/0139315 A1* 6/2011 Nakagaito et al. ..... C23C 2/02 148/533
(Continued)

FOREIGN PATENT DOCUMENTS

JP 2015-218365 A 12/2015
JP 2015-224359 A 12/2015
KR 10-2016-0114660 A 10/2016

OTHER PUBLICATIONS

Extended European Search Report dated Nov. 3, 2020 in European Patent Application No. 18809088.0, 13 pages.
(Continued)

*Primary Examiner* — Seth Dumbris
(74) *Attorney, Agent, or Firm* — Oblon, McClelland, Maier & Neustadt, L.L.P.

(57) ABSTRACT

Disclosed is a high-strength sheet containing: C: 0.15% by mass to 0.35% by mass, a total of Si and Al: 0.5% by mass to 3.0% by mass, Al: 0.01% by mass or more, N: 0.01% by mass or less, Mn: 1.0% by mass to 4.0% by mass, P: 0.05% by mass or less, and S: 0.01% by mass or less, with the balance being Fe and inevitable impurities, wherein the steel structure satisfies that: a ferrite fraction is 5% or less, the
(Continued)

total fraction of tempered martensite and tempered bainite is 60% or more, the amount of retained austenite is 10% or more, MA has an average size of 1.0 μm or less, retained austenite has an average size of 1.0 μm or less, retained austenite having a size of 1.5 μm or more accounts for 2% or more of the total amount of retained austenite, and the amount of solute nitrogen in a steel sheet is 0.002% by mass or less.

20 Claims, 1 Drawing Sheet

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/38*** | (2006.01) |

(52) U.S. Cl.
CPC ..... *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/38* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 8/0236; C21D 8/0263; C21D 9/46; C21D 9/48; C21D 2211/001; C21D 2211/002; C21D 2211/005; C21D 2211/008; C22C 38/00; C22C 38/001; C22C 38/002; C22C 38/005; C22C 38/02; C22C 38/04; C22C 38/06; C22C 38/08; C22C 38/12; C22C 38/14; C22C 38/16; C22C 38/18; C22C 38/38
USPC ..... 148/652; 420/120, 121, 123, 124, 125, 420/126, 127, 128
See application file for complete search history.

(56) References Cited

U.S. PATENT DOCUMENTS

| | | | | |
|---|---|---|---|---|
| 2014/0044585 | A1* | 2/2014 | Naitou ..... | B21D 22/208 420/90 |
| 2014/0182748 | A1 | 7/2014 | Nakagaito et al. | |
| 2017/0107591 | A1 | 4/2017 | Takashima et al. | |
| 2017/0268077 | A1* | 9/2017 | Murakami ..... | C21D 9/46 |

OTHER PUBLICATIONS

International Search Report dated Aug. 14, 2018 in PCT/JP2018/019594 filed on May 22, 2018.

* cited by examiner

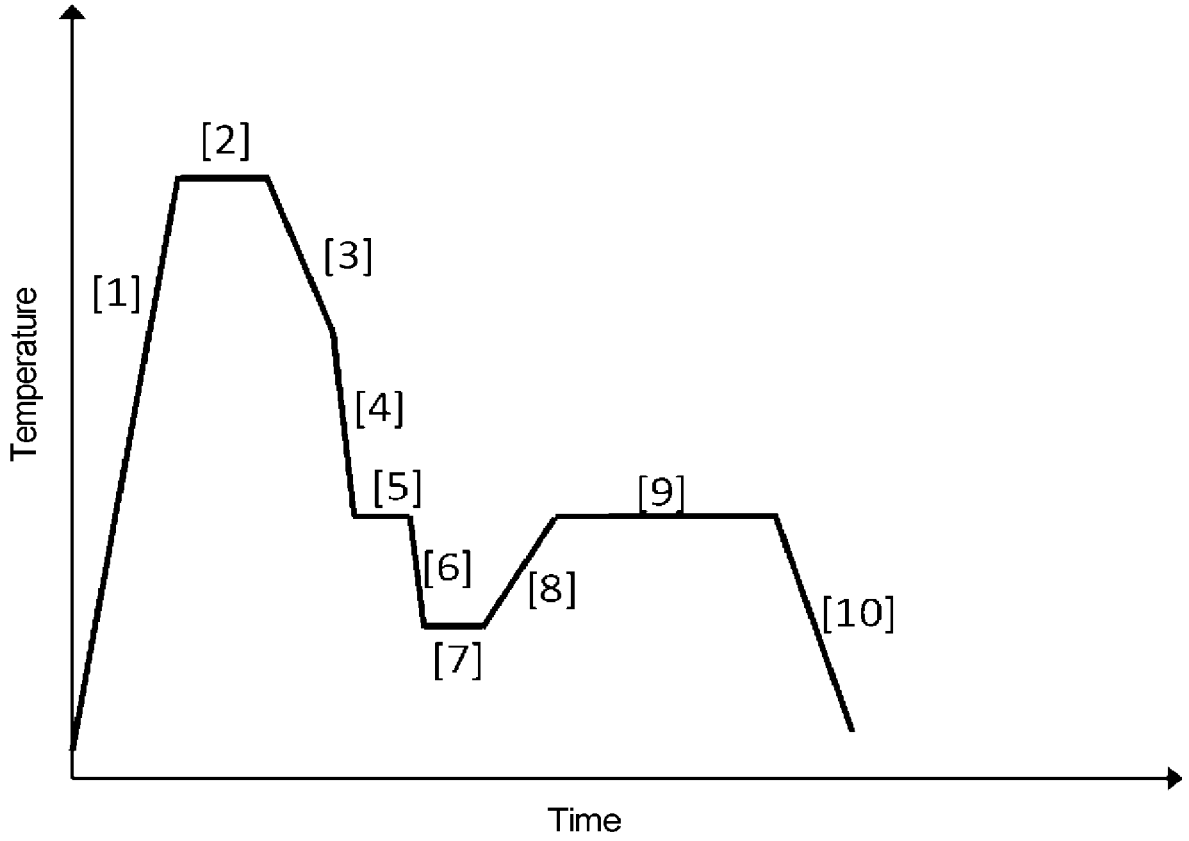
[1]
[2]
[3]
[4]
[5]
[6]
[7]
[8]
[9]
[10]
Temperature
Time

HIGH-STRENGTH STEEL SHEET AND METHOD FOR PRODUCING SAME

TECHNICAL FIELD

The present disclosure relates to a high-strength sheet that can be used in various applications including automobile parts.

BACKGROUND ART

Steel sheets (for example, cold-rolled steel sheets, alloyed hot-dip galvanized steel sheets, etc.) applied to automobile parts (for example, frame parts) and the like are required to undergo thinning in order to realize an improvement in fuel efficiency by reducing the weight of the vehicle body, and the steel sheets are required to have higher strength in order to achieve thinning and to ensure parts strength. Meanwhile, the steel sheets are also required to have excellent workability in order to form into parts having a complicated shape. Patent Document 1 discloses a high-strength sheet that has a tensile strength of 980 MPa to 1,180 MPa and exhibits a good deep drawing property.

PRIOR ART DOCUMENT

Patent Document

Patent Document 1: JP 2009-203548 A

SUMMARY OF THE INVENTION

Problems to be Solved by the Invention

However, in various applications including automobile parts, steel sheets are required to have not only high tensile strength (TS), excellent total elongation (EL) and excellent deep drawability (LDR), but also excellent strength-ductility balance (TS×EL), high yield ratio (YR) and excellent hole expansion ratio (λ).

Specifically, the followings are required for each of the tensile strength, the strength-ductility balance, the yield ratio, the deep drawing property and the hole expansion ratio.

The tensile strength is required to be 980 MPa or higher. The tensile strength is also required to have sufficient value in a welded portion. Specifically, cross tensile strength of a spot welded portion is required to be 6 kN or more.

In order to increase stress that can be applied during use, there is a need to have high yield strength (YS), in addition to high tensile strength (TS). From the viewpoint of ensuring collision safety and the like, there is a need to increase the yield strength of the steel sheet. Therefore, specifically, there is required the yield ratio (YR=YS/TS) of 0.75 or more.

Regarding the strength-ductility balance, a product (TS×EL) of TS and the total elongation (EL) is required to be 20,000 MPa % or higher. In order to ensure the formability during parts forming, it is also required that LDR showing the deep drawability is 2.05 or more and the hole expanding ratio λ showing the hole expansion property is 30% or more. A joint strength of the spot welded portion is also required as basic performances of the steel sheet for automobiles.

However, it is difficult for the high-strength sheet disclosed in Patent Document 1 to satisfy all of these requirements, and there has been required a high-strength steel sheet that can satisfy all of these requirements.

The embodiment of the present invention has been made to respond to these requirements, and it is an object thereof to provide a high-strength sheet in which all of the tensile strength (TS), the cross tensile strength of a spot welded portion (SW cross tension), the yield ratio (YR), the product (TS×EL) of (TS) and the total elongation (EL), the deep drawability (LDR) and the hole expansion ratio (A) are at a high level, and a manufacturing method thereof.

Means for Solving the Problems

Aspect 1 of the present invention provides a high-strength sheet containing:

C: 0.15% by mass to 0.35% by mass, a total of Si and Al: 0.5% by mass to 3.0% by mass, Al: 0.01% by mass or more, N: 0.01% by mass or less, Mn: 1.0% by mass to 4.0% by mass, P: 0.05% by mass or less, and S: 0.01% by mass or less, with the balance being Fe and inevitable impurities, wherein the steel structure satisfies that:

a ferrite fraction is 5% or less, a total fraction of tempered martensite and tempered bainite is 60% or more, an amount of retained austenite is 10% or more, MA has an average size of 1.0 μm or less, retained austenite has an average size of 1.0 μm or less, retained austenite having a size of 1.5 μm or more accounts for 2% or more of the total amount of retained austenite, and the amount of solute nitrogen in a steel sheet is 0.002% by mass or less.

Aspect 2 of the present invention provides the high-strength sheet according to aspect 1, in which the amount of C is 0.30% by mass or less.

Aspect 3 of the present invention provides the high-strength sheet according to aspect 1 or 2, in which the amount of Al is less than 0.10% by mass.

Aspect 4 of the present invention provides the high-strength sheet according to any one of aspects 1 to 3, which further contains one or more of Cu, Ni, Mo, Cr and B, and a total content of Cu, Ni, Mo, Cr and B is 1.0% by mass or less.

Aspect 5 of the present invention provides the high-strength sheet according to any one of aspects 1 to 4, which further contains one or more of Ti, V, Nb, Mo, Zr and Hf, and a total content of Ti, V, Nb, Mo, Zr and Hf is 0.2% by mass or less.

Aspect 6 of the present invention provides the high-strength sheet according to any one of aspects 1 to 5, which further contains one or more of Ca, Mg and REM, and a total content of Ca, Mg and REM is 0.01% by mass or less.

Aspect 7 of the present invention provides a method for manufacturing a high-strength sheet, which includes:

preparing a hot-rolled steel sheet with the composition according to any one of aspects 1 to 6;

pre-annealing the hot-rolled steel sheet at a temperature of 450° C. to an $Ae_1$ point for 10 minutes to 30 hours;

after pre-annealing, subjecting the pre-annealed steel sheet to cold-rolling to obtain a cold-rolled steel sheet;

heating the cold-rolled steel sheet to a temperature of an Acs point or higher to austenitize the cold-rolled steel sheet;

after the austenitization, cooling the austenitized steel sheet between 650° C. and 500° C. at an average cooling rate of 15° C./sec or more and less than 200° C./sec, and then retaining at a temperature in a range of 300° C. to 500° C. at a cooling rate of 10° C./sec or less for 10 seconds or more and less than 300 seconds;

after the retention, cooling the steel sheet from a temperature of 300° C. or higher to a cooling stopping temperature between 100° C. or higher and lower than 300° C. at an average cooling rate of 10° C./sec or more; and heating the steel sheet from the cooling stopping temperature to a reheating temperature in a range of 300° C. to 500° C.

Aspect 8 of the present invention provides the manufacturing method according to aspect 7, in which the retention includes holding at a constant temperature in a range of 300° C. to 500° C.

Effects of the Invention

According to the embodiments of the present invention, it is possible to provide a high-strength sheet in which all of the tensile strength (TS), the cross tensile strength of a spot welded portion(SW cross tension), the yield ratio (YR), the product (TS×EL) of the tensile strength (TS) and the total elongation (EL), the deep drawability (LDR) and the hole expansion ratio (λ) are at a high level, and a manufacturing method thereof.

BRIEF DESCRIPTION OF THE DRAWINGS

FIG. 1 is a diagram explaining a method for manufacturing a high-strength sheet according to the embodiment of the present invention, especially a heat treatment after cold-rolling.

MODE FOR CARRYING OUT THE INVENTION

The inventors of the present application have intensively studied and found that it is possible to obtain a high-strength sheet in which all of the tensile strength (TS), the cross tensile strength of a spot welded portion (SW cross tension), the yield ratio (YR), the product (TS×EL) of the tensile strength (TS) and the total elongation (EL), LDR and the hole expansion ratio (λ) are at a high level by allowing the steel structure (metal structure) to satisfy that: a ferrite fraction is 5% or less, a total fraction of tempered martensite and tempered bainite is 60% or more, an amount of retained austenite is 10% or more, retained austenite has an average size of 1.0 μm or less, retained austenite having a size of 1.5 μm or more accounts for 2% or more of the total amount of retained austenite, and an amount of solute nitrogen in a steel sheet is 0.002% by mass or less, in a steel including predetermined components.

1. Steel Structure and Amount of Solute Nitrogen

The steel structure and the amount of solute nitrogen of the high-strength sheet according to the embodiments of the present invention will be described in detail below.

In the following description of the steel structure, there are cases where mechanisms capable of improving various properties by having such the structure are described. It should be noted that these mechanisms are those envisaged by the inventors of the present application based on the findings currently obtained, but do not limit the technical scope of the present invention.

(1) Ferrite Fraction: 5% or Less

Ferrite generally has excellent workability but has a problem such as low strength. A large amount of ferrite leads to a decrease in the yield ratio. Therefore, the ferrite fraction is set at 5% or less (5 volume % or less).

The ferrite fraction is preferably 3% or less, and more preferably 0%.

The ferrite fraction can be determined by observing with an optical microscope and measuring white region by the point counting method. By this method, it is possible to determine the ferrite fraction by an area ratio (area %). The value obtained by the area ratio may be directly used as a value of a volume ratio (volume %).

(2) Total Fraction of Tempered Martensite and Tempered Bainite: 60% or More

By setting the total fraction of tempered martensite and tempered bainite at 60% or more (60 volume % or more), it is possible to achieve both high strength and high hole expansion property. The total fraction of tempered martensite and tempered bainite is preferably 70% or more.

It is possible to determine the amounts (total fraction) of tempered martensite and tempered bainite by performing SEM observation of a Nital-etched cross-section, measuring a fraction of MA (i.e., a total of retained austenite and martensite as quenched) and subtracting the above-mentioned ferrite fraction and MA fraction from the entire steel structure.

(3) Amount of Retained Austenite: 10% or More

The retained austenite causes the TRIP phenomenon of being transformed into martensite due to strain induced transformation during working such as press working, thus making it possible to obtain large elongation. Furthermore, martensite thus formed has high hardness. Therefore, excellent strength-ductility balance can be obtained. By setting the amount of retained austenite at 10% or more (10 volume % or more), it is possible to realize TS×EL of 20,000 MPa % or more and excellent strength-ductility balance.

The amount of retained austenite is preferably 15% or more.

In the high-strength sheet according to the embodiments of the present invention, most of retained austenite exists in the form of MA. MA is abbreviation of a martensite-austenite constituent and is a composite (complex structure) of martensite and austenite.

It is possible to determine the amount of retained austenite by obtaining a diffraction intensity ratio of ferrite (including bainite, tempered bainite, tempered martensite and untempered martensite in X-ray diffraction) and austenite by X-ray diffraction, followed by calculation. As an X-ray source, Co-Kα ray can be used.

(4) Average Size of MA: 1.0 μm or Less

MA is a hard phase and the vicinity of a matrix/hard phase interface acts as a void forming site during deformation. The larger the MA size, the more strain concentration occurs at the matrix/hard phase interface, and thus this easily causes fracture from voids formed in the vicinity of the matrix/hard phase interface as a starting point.

Therefore, it is possible to improve the hole expansion ratio A by decreasing the MA size, especially the MA average size to 1.0 μm or less, thereby suppressing fracture. The average size of MA is preferably 0.8 μm or less.

It is possible to determine the average size of MA by observing a Nital-etched cross-section in three or more fields of view at a magnification of 3,000 times with SEM, drawing a straight line of 200 μm or more in total in arbitrary position in the micrograph, measuring the length of intercept where the straight line crosses MA, and calculating the average of the intercept lengths.

When drawing the straight line, the length per straight line is at least 20 μm or more.

(5) Average Size of Retained Austenite: 1.0 μm or Less, and Retained Austenite Having Size of 1.5 μm or More: Accounting for 2% or More of Total Amount of Retained Austenite It has been found that excellent deep drawability can be obtained by setting the average size of retained austenite at 1.0 μm and setting the ratio (volume ratio) of retained austenite having a size of 1.5 μm or more to the total amount of retained austenite at 2% or more.

If incoming stress of a flange portion is smaller than tensile stress of a vertical wall portion formed during deep drawing, drawing is easily advanced, and thus good deep drawability can be obtained. Regarding the deformation behavior of the flange portion, since compressive stress is applied from the board surface direction and circumference, formation occurs in a state where isotropic compressive stress is applied. Meanwhile, martensitic transformation is accompanied by volume expansion, so that martensite transformation hardly occurs under isotropic compressive stress. Therefore, strain induced martensite transformation of retained austenite at the flange portion is suppressed to reduce work hardening.

As a result, the deep drawability is improved. As the size of retained austenite increases, the greater effect of suppressing martensitic transformation is exhibited.

In order to increase the tensile stress of the vertical wall portion formed by deep drawing, it is necessary to maintain a high work hardening rate during deformation. Unstable retained austenite that easily undergoes strain induced transformation under relatively low stress and stable retained austenite that does not undergo strain induced transformation unless high stress is applied are allowed to coexist to cause strain induced transformation over a wide stress range, thus making it possible to maintain a high work hardening rate during deformation. Therefore, a study was made to obtain a steel structure containing a predetermined amounts of each of unstable coarse retained austenite and stable fine retained austenite. Thus, the inventors of the present application have found that a high work hardening rate is maintained during deformation by setting the average size of retained austenite at 1.0 μm and setting the ratio (volume ratio) of the amount of retained austenite having a size of 1.5 μm or more to the total amount of retained austenite at 2% or more, thus making it possible to obtain excellent deep drawability (LDR).

As mentioned above, when retained austenite undergoes strain induced transformation, the TRIP phenomenon occurs and high elongation can be obtained. Meanwhile, the martensitic structure formed by strain induced transformation is hard and acts as a starting point of fracture. Larger martensite structure easily acts as the starting point of fracture. It is also possible to obtain the effect of suppressing fracture by setting the average size of retained austenite at 1.0 μm or less to reduce the size of martensite formed by strain induced transformation.

It is possible to determine the average size of retained austenite and the ratio of the amount of retained austenite having a size of 1.5 μm or more to the total amount of retained austenite by creating a Phase map using EBSD (electron back scatter diffraction patterns) method that is a crystal analysis method using SEM. An area of each austenite phase (retained austenite) is obtained from the obtained Phase map and an equivalent circle diameter (diameter) of each austenite phase is obtained from the area, and then an average of the obtained diameters is taken as the average size of retained austenite. It is possible to obtain the ratio of retained austenite having a size of 1.5 μm or more to the total amount of retained austenite by integrating the area of the austenite phase having an equivalent circle diameter of 1.5 μm or more to determine the ratio of austenite phase to the total area of the austenite phase. The thus obtained ratio of the retained austenite having a size of 1.5 μm or more to the total amount of retained austenite is the area ratio and is equivalent to the volume ratio.

(6) Amount of Solute Nitrogen in Steel Sheet is 0.002% by Mass or Less

The inventors of the present application have found that solute nitrogen in the steel sheet exerts an influence on the stretch flangeability (hole expansion properties). Reduction in amount of solute nitrogen in the steel sheet to 0.002% by mass or less enables an improvement in stretch flangeability (hole expansion property).

Regarding the amount of solute nitrogen in the steel sheet, the total amount of nitrogen in the steel sheet is determined by chemical component analysis and a difference from compound-type nitrogen is defined as "amount of solute nitrogen". The amount of the compound-type nitrogen is determined by filtering an electrolytic solution after electrolytic extraction of the steel sheet through a filter having a mesh diameter of 0.1 μm and measuring the amount of the residue remaining on the filter by the indophenol blue absorption photometry. The amount of solute nitrogen is preferably 0.002% by mass or less, and more preferably 0.0015% by mass or less.

(7) Other Steel Structure:

In the present specification, steel structures other than the above-mentioned ferrite, tempered martensite, tempered bainite and retained austenite are not specifically defined. However, pearlite, untempered bainite, untempered martensite and the like may exist, in addition to the steel structures such as ferrite. As long as the steel structure such as ferrite satisfies the above-mentioned structure conditions, the effects of the embodiments of the present invention are exhibited even if perlite and the like exist.

2. Composition

The composition of the high-strength sheet according to the embodiments of the present invention will be described below. First, main elements will be described, and then elements that may be selectively added will be described.

Note that all percentages as unit with respect to the composition are by mass.

(1) C: 0.15 to 0.35%

C is an element indispensable for ensuring properties such as high (TS×EL) by obtaining the desired structure. In order to effectively exhibit such effect, it is necessary to add C in the amount of 0.15% or more. However, the amount of more than 0.35% is not suitable for welding, thus failing to obtain sufficient welding strength. The amount of C is preferably 0.17% or more, and more preferably 0.18% or more. The amount is preferably 0.30% or less. If the amount of C is 0.30% or less, welding can be easily performed.

(2) Total of Si and Al: 0.5 to 3.0%

Si and Al each have an effect of suppressing precipitation of cementite, thus accelerating formation of retained austenite. In order to effectively exhibit such effect, it is necessary to add Si and Al in the total amount of 0.5% or more. However, if the total amount of Si and Al exceeds 3.0%, MA that is the mixed structure of retained austenite and martensite is coarse, thus degrading the hole expansion ratio. The total amount is preferably 0.7% or more, and more preferably 1.0% or more. The total amount is preferably 2.5% or less, and more preferably 2.0% or less.

(3) Al: 0.01% or More

Al is added in the amount enough to function as a deoxidizing element, i.e., 0.01% or more. Al may be added in the amount of less than 0.10%. For example, for the purpose of suppressing formation of cementite to increase the amount of retained austenite, Al may be added in a larger amount of 0.7% by mass or more.

(4) Mn: 1.0 to 4.0%

Mn suppresses formation of ferrite. In order to effectively exhibit such effect, it is necessary to add Mn in the amount of 1.0% or more. However, if the amount exceeds 4.0%, bainite transformation is suppressed, thus failing to form relatively coarse retained austenite. Therefore, it is impossible to improve the deep drawability. The content of Mn is preferably 1.5% or more, and more preferably 2.0% or more. The content is preferably 3.5% or less.

(5) P: 0.05% or Less

P inevitably exists as an impurity element. If more than 0.05% of P exists, EL and λ are degraded. Therefore, the content of P is set at 0.05% or less (including 0%). Preferably, the content is 0.03% or less (including 0%).

(6) S: 0.01% or Less

S inevitably exists as an impurity element. If more than 0.01% of S exists, sulfide-based inclusions such as MnS are formed, which act as a starting point of cracking, thus degrading λ. Therefore, the content of S is set at 0.01% or less (including 0%). The content is preferably 0.005% or less (including 0%).

(7) N: 0.01% or Less

Excessive content of N leads to an increase in a precipitation amount of nitride, thus exerting an adverse influence on the toughness. Therefore, the amount of N is set at 0.01% or less. The amount of N is preferably 0.008% or less, and more preferably 0.006% or less. Taking steelmaking costs into consideration, the content of N is usually 0.001% or more.

(8) Balance

In a preferred embodiment, the balance is composed of iron and inevitable impurities. As inevitable impurities, it is permitted to mix trace elements (e.g., As, Sb, Sn, etc.) introduced according to conditions of raw materials, materials, manufacturing facilities and the like. There are elements whose content is preferably as small as possible, for example like P and S, that are therefore inevitable impurities in which the composition range is separately defined as mentioned above. Therefore, "inevitable impurities" constituting the balance as used herein means the concept excluding the elements whose composition ranges are separately defined.

However, the present invention is not limited to the composition of these embodiments. As long as properties of the high-strength steel sheet according to the embodiments of the present invention can be maintained, arbitrary other element may be further contained. Other elements capable of being selectively contained in such manner will be mentioned below.

(9) One or More of Cu, Ni, Mo, Cr and B: Total Content of 1.0% or Less

These are elements that are useful as steel strengthening elements and are effective in stabilizing retained austenite to ensure a predetermined amount thereof. In order to effectively exhibit such effects, these elements are preferably contained in the total amount of 0.001% or more, and more preferably 0.01% or more. However, the effects are saturated even if these elements are excessively contained, resulting in economic waste. Therefore, these elements are contained in the total amount of 1.0% or less, and preferably 0.5% or less.

(10) One or More of Ti, V, Nb, Mo, Zr and Hf: Total Content of 0.2% or Less

These are elements that have effects of precipitation strengthening and structure refining and are useful for achieving higher strength. In order to effectively exhibit such effect, these elements are preferably contained in the total amount of 0.01% or more, and more preferably 0.02% or more. However, the effects are saturated even if these elements are excessively contained, resulting in economic waste. Therefore, these elements are contained in the total amount of 0.2% or less, and preferably 0.1% or less.

(11) One or More of Ca, Mg and REM: Total Content of 0.01% or Less

These are elements that are effective in controlling form of sulfides in steel to improve workability. Here, REM (rare earth element) used in the embodiments of the present invention include Sc, Y, lanthanoid and the like. In order to effectively exhibit such effect, these elements are preferably included in the total amount of 0.001% or more, and more preferably 0.002% or more. However, the effect is saturated even if these elements are excessively contained, resulting in economic waste. Therefore, these elements are contained in the total amount of 0.01% or less, and preferably 0.005% or less.

3. Properties

As mentioned above, regarding the high-strength sheet according to the embodiments of the present invention, all of TS, YR, TS×EL, LDR, λ and SW cross tension are at a high level. These properties of the high-strength sheet according to the embodiments of the present invention will be described in detail below.

(1) Tensile Strength (TS)

The high-strength sheet has TS of 980 MPa or higher. This makes it possible to ensure sufficient strength.

(2) Yield Ratio (YR)

The high-strength sheet has the yield ratio of 0.75 or more. This makes it possible to realize a high yield strength combined with the above-mentioned high tensile strength and to use a final product under high stress, which is obtained by working such as deep drawing. Preferably, the high-strength sheet has the yield ratio of 0.80 or more.

(3) The Product (TS×EL) of TS and Total Elongation (EL)

TS×EL is 20,000 MPa % or more. By having TS×EL of 20,000 MPa % or more, it is possible to obtain high-level strength-ductility balance that has both high strength and high ductility simultaneously. Preferably, TS×EL is 23,000 MPa % or more.

(4) Deep Drawability (LDR)

LDR is an index used for evaluation of the deep drawability. In cylindrical drawing, D/d is referred to as LDR (limiting drawing ratio), where d denotes a diameter of a cylinder obtained in cylindrical drawing and D denotes a maximum diameter of a disk-shaped steel sheet (blank) capable of obtaining a cylinder without causing fracture by one deep drawing process. More specifically, disk-shaped samples having a thickness of 1.4 mm and various diameters are subjected to cylindrical deep drawing using a die having a punch diameter of 50 mm, a punch angle radius of 6 mm, a die diameter of 55.2 mm and a die angle radius of 8 mm. It is possible to obtain LDR by determining a maximum sample diameter (maximum diameter D) among the sample diameters of the disc-shaped samples that were drawn without causing fracture.

The high-strength sheet according to the embodiments of the present invention has LDR of 2.05 or more, and preferably 2.10 or more, and thus has excellent deep drawability.

(5) Hole Expansion Ratio (λ)

The hole expansion ratio λ is determined in accordance with JIS Z 2256. A punched hole having a diameter $d_0$ ($d_0$=10 mm) is formed in a test piece and a punch having a tip angle of 60° is pushed into this punched hole, and a diameter d of the punched hole at the time when generated cracking penetrated the thickness of the test piece is measured, and then the hole expansion ratio is calculated by the following formula.

$$\lambda(\%)=\{(d-d_0)/d_0\}\times 100$$

The high-strength sheet according to the embodiments of the present invention has the hole expansion ratio λ of 30% or more, and preferably 40% or more. This makes it possible to obtain excellent workability such as press formability.

(6) Cross Tensile Strength of Spot Welded Portion (SW Cross Tension)

The cross tensile strength of the spot welded portion is evaluated in accordance with JIS Z 3137. Conditions of spot welding are as follows. Using two steel sheets (1.4 mm-thick steel sheets in Examples mentioned later) laid one upon another, spot welding is performed under a welding pressure of 4 kN at a current pitch of 0.5 kA in a range from 6 kA to 12 kA by a dome radius type electrode, thereby determining the minimum current value at which dust is generated. Then, the cross tensile strength of a cross joint is measured, which is obtained by spot-welding at a current that is 0.5 kA lower than the minimum current value at which dust is generated.

In the high-strength sheet according to the embodiments of the present invention, the cross tensile strength of the spot welded portion (SW cross tension) is 6 kN or more, preferably 8 kN or more, and more preferably 10 kN or more.

4. Manufacturing Method

The method for manufacturing a high-strength sheet according to the embodiments of the present invention will be described below.

The inventors of the present application have found that the above-mentioned desired steel structure is attained by subjecting a rolled material with predetermined composition to a heat treatment (multi-step austempering treatment) mentioned later, thus obtaining a high-strength steel sheet having the above-mentioned desired properties.

Details Will be Described Below (1) Preparation of Hot-Rolled Steel Sheet and Pre-Annealing A hot-rolled steel sheet with the composition mentioned above is prepared. The hot-rolling conditions are not particularly limited and the hot-rolled steel sheet is produced by a usual hot-rolling process.

The thus obtained rolled steel sheet is heated to a pre-annealing temperature of 450° C. or higher and an $Ae_1$ point or lower and then subjected to pre-annealing treatment at this pre-annealing temperature for 10 minutes to 30 hours.

By this annealing process, precipitation of AlN is accelerated to reduce solute nitrogen remaining in the hot-rolled steel sheet.

The $Ae_1$ point can be determined using the following formula:

$$Ae_1\ \text{point}(^\circ\ \text{C.})=723-10.7\times[\text{Mn}]+29.1\times[\text{Si}]$$

where [ ] each denote the content in % by mass of each element.

If the pre-annealing temperature is lower than 450° C., the precipitation of AlN is insufficient, and thus a predetermined amount or more of solute nitrogen is remained in the steel sheet that is the final product. If the pre-annealing temperature exceeds the $Ae_1$ point, martensite is formed in the cooling process after pre-annealing, so that the steel sheet may be fractured during subsequent cold-rolling. Therefore, the pre-annealing temperature is preferably set at 450° C. to the $Ae_1$ point.

If the pre-annealing time is less than 10 minutes, the precipitation of AlN is insufficient, and thus a predetermined amount or more of solute nitrogen is remained in the steel sheet that is the final product. In order to reduce the amount of solute nitrogen, the steel sheet may be subjected to pre-annealing for a long time. However, even if the annealing time is excessively increased, the effect is saturated and the productivity is degraded, so that the annealing time is preferably set at 30 hours or less.

(2) Fabrication of Cold-Rolled Steel Sheet

The pre-annealed hot-rolled steel sheet is subjected to pickling to remove the scale, and then cold-rolled to obtain a cold-rolled steel sheet. The cold-rolling conditions are not particularly limited.

The cold-rolled steel sheet thus obtained is subjected to the below-mentioned heat treatment to form a desired steel sheet structure, and thus a high-strength sheet having desired properties is obtained.

A description will be made on a heat treatment suited for the production of a steel sheet according to the embodiments of the present invention with reference to FIG. 1. FIG. 1 is a diagram explaining a method for manufacturing a high-strength sheet according to the embodiments of the present invention, especially a heat treatment (heat treatment process of the below-mentioned (3) to (6)) after cold-rolling.

(3) Austenitizing Treatment

As shown in [1] and [2] of FIG. 1, a cold-rolled steel sheet is heated to a temperature of an Acs point or higher, thereby the cold-rolled steel sheet is austenitized. The cold-rolled steel sheet may be held at this heating temperature for 1 to 1,800 seconds. The heating temperature is preferably the $Ac_3$ point or higher, and the $Ac_3$ point+100° C. or lower. This is because grain coarsening can be further suppressed by setting at the temperature of the $Ac_3$ point+100° C. or lower. The heating temperature is more preferably the $Ac_3$ point+10° C. or higher and the $Ac_3$ point+90° C. or lower, and further preferably the $Ac_3$ point+20° C. or higher and the $Ac_3$ point+80° C. or lower. This is because the formation of ferrite can be more completely suppressed by more complete austenitizing and grain coarsening can be more surely suppressed.

Heating during austenitization shown in [1] of FIG. 1 may be performed at an arbitrary heating rate, and the average heating rate is preferably 1° C./sec or more and less than 20° C./sec.

The $Ac_3$ point can be determined using the following formula:

$$Ac_3\ \text{point}(^\circ\ \text{C.})=911-203\times\sqrt{[\text{C}]}+44.7\times[\text{Si}]-30\times[\text{Mn}]+400\times[\text{Al}]$$

where [ ] each denote the content in % by mass of each element.

(4) Cooling and Retaining at Temperature in Range of 300° C. to 500° C.

After the austenitization, cooling is performed, followed by retention at a temperature in a range of 300° C. to 500° C. at a cooling rate of 10° C./sec or less for 10 seconds or more and less than 300 seconds, as shown in [5] of FIG. 1.

Cooling is performed at an average cooling rate of 15° C./sec or more and less than 200° C./sec between at least 650° C. and 500° C. This is because the formation of ferrite during cooling is suppressed by setting the average cooling rate at 15° C./sec or more. It is also possible to prevent the occurrence of excessive thermal strain due to rapid cooling by setting the cooling rate at less than 200° C./sec. Preferred example of such cooling includes cooling to a rapid cooling starting temperature of 650° C. or higher at relatively low average cooling rate of 0.1° C./sec or more and 10° C./sec or less, as shown in [3] of FIG. 1, followed by cooling from the rapid cooling starting temperature to a retention starting temperature of 500° C. or lower at an average cooling rate of 20° C./sec or more and less than 200° C./sec, as shown in [4] of FIG. 1.

Retention is performed at a temperature in a range of 300° C. to 500° C. at a cooling rate of 10° C./sec or less for 10 seconds or more and less than 300 seconds. In other words, the steel is left to stand at a temperature in a range of 300° C. to 500° C. in a state where the cooling rate is 10° C./sec or less for 10 seconds or more and less than 300 seconds. The state where the cooling rate is 10° C./sec or less also includes the case of holding at substantially constant temperature (i.e., cooling rate is 0° C./sec), as shown in [5] of FIG. 1.

This retention enables partial formation of bainite. Since bainite has solid solubility limit of carbon that is lower than that of austenite, carbon exceeding the solid solubility limit is discharged from bainite, and thus a region of austenite, in which carbon is concentrated, is formed around austenite.

After cooling and reheating mentioned later, this region becomes somewhat coarse retained austenite (specifically, retained austenite having a size of 1.5 μm or more). By forming this "somewhat coarse retained austenite", it is possible to enhance the deep drawability as mentioned above.

If the retention temperature is higher than 500° C., since the carbon-concentrated region is excessively large, not only retained austenite but also MA are coarse, and thus the hole spreading ratio is degraded. Meanwhile, if the retention temperature is lower than 300° C., the carbon-concentrated region is small and the amount of coarse retained austenite is insufficient, and thus the deep drawability is degraded.

If the retention time is less than 10 seconds, the area of the carbon-concentrated region is small and the amount of coarse retained austenite is insufficient, and thus the deep drawability is degraded. Meanwhile, if the retention time is 300 seconds or more, since the carbon-concentrated region is excessively large, not only retained austenite but also MA are coarse, thus the hole expansion ratio is degraded.

If the cooling rate during retention is more than 10° C./sec, since sufficient bainite transformation does not occur, sufficient carbon-concentrated region is not formed, and this leads to insufficient amount of coarse retained austenite.

Therefore, retention is performed at a temperature in a range of 300° C. to 500° C. at a cooling rate of 10° C./sec or less for 10 seconds or more and less than 300 seconds. Retention is preferably performed at a temperature in a range of 320° C. to 480° C. at a cooling rate of 8° C./sec or less for 10 seconds or more and, during the retention, holding is preferably performed at a constant temperature for 3 to 80 seconds.

Retention is more preferably performed at a temperature in a range of 340° C. to 460° C. at a cooling rate of 3° C./sec or less for 10 seconds or more and, during the retention, holding is performed a constant temperature for 5 to 60 seconds.

(5) Cooling to Cooling Stopping Temperature Between 100° C. or Higher and Lower than 300° C.

After the above-mentioned retention, as shown in [6] of FIG. 1, cooling is performed from a second cooling starting temperature of 300° C. or higher to a cooling stopping temperature of 100° C. or higher and lower than 300° C. at an average cooling rate of 10° C./sec or more. In one of preferred embodiments, as shown in [6] of FIG. 1, the above-mentioned retention end temperature (e.g., holding temperature shown in [5] of FIG. 1) is taken as the second cooling starting temperature.

This cooling causes martensitic transformation while leaving the above-mentioned carbon-concentrated region as austenite. By controlling the cooling stopping temperature at a temperature in a range of 100° C. or higher and lower than 300° C., the amount of austenite remaining without being transformed into martensite is adjusted, and final amount of retained austenite is controlled.

If the cooling rate is less than 10° C./sec, the carbon-concentrated region expands more than necessarily during cooling and MA is coarse, and thus the hole spreading ratio is degraded. If the cooling stopping temperature is lower than 100° C., the amount of retained austenite is insufficient. As a result, TS increases but EL decreases, and this leads to insufficient TS×EL balance.

If the cooling stopping temperature is 300° C. or higher, coarse untransformed austenite increases and remains even after the subsequent cooling. Finally, the size of MA is larger, and thus the hole expansion ratio λ is degraded.

The cooling rate is preferably 15° C./sec or more, and the cooling stopping temperature is preferably 120° C. or higher and 280° C. or lower. The cooling rate is more preferably 20° C./sec or more, and the cooling stopping temperature is more preferably 140° C. or higher and 260° C. or lower.

As shown in [7] of FIG. 1, holding may be performed at the cooling stopping temperature. In the case of holding, the holding time is preferably 1 to 600 seconds. Even if the holding time increases, there is almost no influence on properties. However, the holding time of more than 600 seconds degrades the productivity.

(6) Reheating to Temperature in Range of 300° C. to 500° C.

As shown in [8] of FIG. 1, heating is performed from the above cooling stopping temperature to a reheating temperature in a range of 300° C. to 500° C. The heating rate is not particularly limited. After reaching the reheating temperature, holding is preferably performed at the same temperature, as shown in [9] of FIG. 1. The holding time is preferably 50 to 1,200 seconds.

This reheating expels carbon in martensite to accelerate the condensation of carbon in austenite around martensite, and this leads to stabilization of austenite. This makes it possible to increase the amount of retained austenite obtained finally.

If the reheating temperature is lower than 300° C., diffusion of carbon is insufficient, and sufficient amount of retained austenite is not obtained, and this leads to a decrease in TS×EL. If holding is not performed or the holding time is less than 50 seconds, diffusion of carbon may be insufficient, similarly. Therefore, it is preferred to hold at a reheating temperature for 50 second or more.

If the reheating temperature is higher than 500° C., carbon is precipitated as cementite, and thus sufficient amount of retained austenite cannot be obtained, and this leads to a decrease in TS×EL. In addition, if the holding time is more than 1,200 seconds, carbon may precipitate as cementite, similarly. Therefore, the holding time is preferably 1,200 seconds or less.

The reheating temperature is preferably 320° C. to 480° C. and, in this case, the upper limit of the holding time is preferably 900 seconds. The reheating temperature is more preferably 340° C. to 460° C. and, in this case, the upper limit of the holding time is preferably 600 seconds.

After reheating, as shown in [10] of FIG. 1, cooling may be performed to the temperature of 200° C. or lower, for example, room temperature. The average cooling rate to 200° C. or lower is preferably 10° C./sec or more.

Through the above processes (1) to (6), the high-strength sheet according to the embodiments of the present invention can be obtained.

There is a possibility that a person skilled in the art, who contacted the method of manufacturing a high-strength steel sheet according to the embodiments of the present invention described above can obtain the high strength steel sheet according to the embodiments of the present invention by trial and error, using a manufacturing method different from the above-mentioned method.

EXAMPLES

1. Fabrication of Samples

After producing each cast material with the chemical composition shown in Table 1 by vacuum melting, each of these cast materials was hot-forged to form a steel sheet having a thickness of 30 mm and then hot-rolled. In Table 1, $Ac_3$ points calculated from the composition are also shown.

Although the conditions of hot-rolling do not have a substantial influence on the final structure and properties of the embodiments of the present invention, a steel sheet having a thickness of 2.5 mm was produced by multistage rolling after heating to 1,200° C. At this time, the end temperature of hot-rolling was set at 880° C. After that, cooling was performed to 600° C. at 30° C./sec, and then cooling was stopped. The steel sheet was inserted into a furnace heated to 600° C., held for 30 minutes and then furnace-cooled to obtain a hot-rolled steel sheet.

This hot-rolled steel sheet was subjected to pre-annealing. The pre-annealing conditions (pre-annealing temperature and pre-annealing time) are shown in Table 2-1 and Table 2-2.

The pre-annealed hot-rolled steel sheet was subjected to pickling to remove the scale on the surface, and then cold-rolled to reduce the thickness to 1.4 mm. This cold rolled sheet was subjected to a heat treatment to obtain samples. The heat treatment conditions are shown in Table 2-1 and Table 2-2. The number in parentheses, for example, [2] in Table 2-1 and Table 2-2 corresponds to the process of the same number in parentheses in FIG. 1. In Table 2-1 and Table 2-2, sample No. 4 is sample (sample in which the steps corresponding to [5] and [6] in FIG. 1 were skipped) that were immediately cooled to 200° C. after starting rapid cooling at 700° C. Sample No. 10 is sample (sample in which the steps corresponding to [6] to [8] in FIG. 1 were skipped) in which cooling was not stopped at a cooling stopping temperature between 100° C. or higher and lower than 300° C., and reheating was not performed.

In each Table, the underlined numerical value indicates that it deviates from the range of the embodiments of the present invention. It should be noted that "-" is not underlined even if it deviates from the range of the embodiments of the present invention.

TABLE 1

| | Composition | | | | | | | | | | |
|---|---|---|---|---|---|---|---|---|---|---|---|
| Steel No. | C % by mass | Si % by mass | Mn % by mass | P % by mass | S % by mass | Al % by mass | Si + Al % by mass | N % by mass | Others % by mass | $Ae_1$ ° C. | $Ac_3$ ° C. |
| a | 0.28 | 1.32 | 1.98 | 0.015 | 0.003 | 0.02 | 1.34 | 0.0042 | | 740 | 811 |
| b | 0.18 | 1.09 | 2.09 | 0.013 | 0.002 | 0.03 | 1.12 | 0.0041 | | 732 | 823 |
| c | 0.32 | 1.58 | 1.93 | 0.007 | 0.002 | 0.02 | 1.60 | 0.0044 | | 748 | 817 |
| d | 0.21 | 2.09 | 1.78 | 0.012 | 0.001 | 0.04 | 2.13 | 0.0042 | | 765 | 874 |
| e | 0.12 | 1.41 | 2.50 | 0.010 | 0.002 | 0.04 | 1.45 | 0.0039 | | 737 | 845 |
| f | 0.19 | 1.26 | 5.18 | 0.009 | 0.002 | 0.04 | 1.30 | 0.0039 | | 704 | 739 |
| g | 0.21 | 1.53 | 0.61 | 0.015 | 0.001 | 0.04 | 1.57 | 0.0042 | | 761 | 884 |
| h | 0.25 | 0.20 | 2.18 | 0.007 | 0.001 | 0.03 | 0.23 | 0.0045 | | 705 | 765 |
| i | 0.45 | 1.51 | 1.67 | 0.011 | 0.002 | 0.02 | 1.53 | 0.0045 | | 749 | 800 |
| j | 0.29 | 3.20 | 1.60 | 0.014 | 0.001 | 0.03 | 3.23 | 0.0047 | | 799 | 908 |
| k | 0.24 | 1.05 | 1.75 | 0.010 | 0.002 | 0.04 | 1.09 | 0.0042 | | 735 | 823 |
| l | 0.28 | 1.10 | 1.96 | 0.007 | 0.002 | 0.02 | 1.12 | 0.0041 | | 734 | 802 |
| m | 0.29 | 1.50 | 2.19 | 0.015 | 0.003 | 0.04 | 1.54 | 0.0043 | | 743 | 819 |
| n | 0.21 | 1.62 | 1.99 | 0.006 | 0.002 | 0.04 | 1.66 | 0.0041 | | 749 | 846 |
| o | 0.28 | 0.83 | 2.31 | 0.008 | 0.002 | 0.25 | 1.08 | 0.0043 | | 722 | 871 |
| p | 0.20 | 1.42 | 2.24 | 0.010 | 0.003 | 0.02 | 1.44 | 0.0044 | | 740 | 825 |
| q | 0.21 | 1.26 | 1.80 | 0.007 | 0.001 | 0.04 | 1.30 | 0.0045 | Ti: 0.02 | 740 | 836 |
| r | 0.28 | 1.28 | 1.98 | 0.010 | 0.002 | 0.02 | 1.30 | 0.0045 | Cu: 0.2 | 739 | 809 |
| s | 0.27 | 1.25 | 2.03 | 0.012 | 0.003 | 0.03 | 1.28 | 0.0046 | Ni: 0.2 | 738 | 813 |
| t | 0.30 | 1.28 | 1.98 | 0.009 | 0.002 | 0.02 | 1.30 | 0.0045 | Cr: 0.1 | 739 | 806 |
| u | 0.29 | 1.29 | 1.96 | 0.008 | 0.001 | 0.03 | 1.32 | 0.0044 | Mo: 0.1 | 740 | 813 |
| v | 0.28 | 1.33 | 1.98 | 0.009 | 0.001 | 0.03 | 1.36 | 0.0044 | B: 0.002 | 741 | 816 |
| w | 0.25 | 1.28 | 1.97 | 0.011 | 0.002 | 0.04 | 1.32 | 0.0043 | V: 0.05 | 739 | 823 |
| x | 0.26 | 1.27 | 2.04 | 0.010 | 0.003 | 0.03 | 1.30 | 0.0043 | Nb: 0.05 | 738 | 815 |
| y | 0.27 | 1.30 | 1.98 | 0.010 | 0.002 | 0.03 | 1.33 | 0.0041 | Mg: 0.002 | 740 | 816 |
| z | 0.31 | 1.33 | 1.99 | 0.012 | 0.003 | 0.03 | 1.36 | 0.0043 | REM: 0.002 | 740 | 810 |

TABLE 2-1

| No. | Steel No. | Heat treatment conditions: Pre-annealing temperature ° C. | Pre-annealing time Min | [1] Heating rate ° C./sec | [1] Heating temperature ° C. | [2] Holding time Sec | [3] Cooling rate ° C./sec | [4] Rapid cooling starting temperature ° C. | [4] Cooling rate ° C./sec |
|---|---|---|---|---|---|---|---|---|---|
| 1 | a | — | — | 10 | 850 | 120 | 10 | 700 | 28 |
| 2 | a | 300 | 1,200 | 10 | 850 | 120 | 10 | 700 | 28 |
| 3 | a | 500 | 5 | 10 | 850 | 120 | 10 | 700 | 28 |
| 4 | a | 500 | 1,200 | 10 | 850 | 120 | 10 | 700 | 28 |
| 5 | a | 500 | 1,200 | 10 | 850 | 120 | 10 | 700 | 28 |
| 6 | a | 500 | 1,200 | 10 | 850 | 120 | 10 | 700 | 28 |
| 7 | a | 500 | 1,200 | 10 | 850 | 120 | 10 | 700 | 28 |
| 8 | a | 500 | 1,200 | 10 | 850 | 120 | 10 | 700 | 28 |
| 9 | a | 500 | 1,200 | 10 | 850 | 120 | 10 | 700 | 28 |
| 10 | a | 500 | 1,200 | 10 | 850 | 120 | 10 | 700 | 28 |
| 11 | a | 500 | 1,200 | 10 | 780 | 120 | 10 | 700 | 28 |
| 12 | a | 500 | 1,200 | 10 | 850 | 120 | 10 | 700 | 28 |
| 13 | a | 500 | 1,200 | 10 | 850 | 120 | 10 | 700 | 28 |
| 14 | a | 500 | 1,200 | 10 | 850 | 120 | | 850 | 28 |
| 15 | a | 500 | 1,200 | 10 | 850 | 120 | 10 | 580 | 28 |
| 16 | a | 500 | 1,200 | 10 | 850 | 120 | 10 | 700 | 28 |
| 17 | a | 500 | 1,200 | 10 | 850 | 120 | 10 | 700 | 8 |
| 18 | a | 500 | 1,200 | 10 | 850 | 120 | 10 | 700 | 28 |
| 19 | a | 500 | 1,200 | 10 | 850 | 120 | 10 | 700 | 28 |
| 20 | a | 500 | 1,200 | 10 | 850 | 120 | 10 | 700 | 28 |
| 21 | a | 500 | 1,200 | 10 | 850 | 120 | 10 | 700 | 28 |
| 22 | b | 500 | 1,200 | 10 | 850 | 120 | 10 | 700 | 28 |
| 23 | c | 500 | 1,200 | 10 | 850 | 120 | 10 | 700 | 28 |
| 24 | d | 500 | 1,200 | 10 | 900 | 120 | 10 | 700 | 28 |
| 25 | e | 500 | 1,200 | 10 | 900 | 120 | 10 | 700 | 28 |

| No. | Heat treatment conditions: [5] Holding temperature ° C. | [5] Holding time Sec | [6] Cooling rate ° C./sec | [6] Cooling stopping temperature ° C. | [7] Holding time Sec | [8] Reheating temperature ° C. | [9] Holding time Sec | [10] Cooling rate ° C./sec |
|---|---|---|---|---|---|---|---|---|
| 1 | 400 | 50 | 30 | 200 | 50 | 400 | 300 | 10 |
| 2 | 400 | 50 | 30 | 200 | 50 | 400 | 300 | 10 |
| 3 | 400 | 50 | 30 | 200 | 50 | 400 | 300 | 10 |
| 4 | — | — | — | 200 | 50 | 400 | 300 | 10 |
| 5 | 400 | 300 | 30 | 200 | 50 | 400 | 300 | 10 |
| 6 | 400 | 50 | 1 | 200 | 50 | 400 | 300 | 10 |
| 7 | 400 | 3 | 30 | 200 | 50 | 400 | 300 | 10 |
| 8 | 550 | 50 | 30 | 200 | 50 | 400 | 300 | 10 |
| 9 | 250 | 50 | 30 | 200 | 50 | 400 | 300 | 10 |
| 10 | 400 | 300 | — | — | — | — | — | 10 |
| 11 | 400 | 50 | 30 | 200 | 50 | 400 | 300 | 10 |
| 12 | 400 | 50 | 30 | 200 | 50 | 400 | 300 | 10 |
| 13 | 400 | 50 | 30 | 20 | 50 | 400 | 300 | 10 |
| 14 | 400 | 50 | 30 | 200 | 50 | 400 | 300 | 10 |
| 15 | 400 | 50 | 30 | 200 | 50 | 400 | 300 | 10 |
| 16 | 400 | 50 | 30 | 200 | 50 | 400 | 300 | 10 |
| 17 | 400 | 50 | 30 | 200 | 50 | 400 | 300 | 10 |
| 18 | 400 | 50 | 30 | 200 | 50 | 550 | 300 | 10 |
| 19 | 400 | 50 | 30 | 200 | 50 | 250 | 300 | 10 |
| 20 | 400 | 50 | 30 | 200 | 50 | 350 | 300 | 10 |
| 21 | 400 | 50 | 30 | 200 | 50 | 420 | 260 | 10 |
| 22 | 400 | 50 | 30 | 200 | 50 | 400 | 300 | 10 |
| 23 | 400 | 50 | 30 | 200 | 50 | 400 | 300 | 10 |
| 24 | 400 | 50 | 30 | 200 | 50 | 400 | 300 | 10 |
| 25 | 400 | 50 | 30 | 200 | 50 | 400 | 300 | 10 |

TABLE 2-2

| No. | Steel No. | Heat treatment conditions: Pre-annealing temperature ° C. | Pre-annealing time Min | [1] Heating rate ° C./sec | [1] Heating temperature ° C. | [2] Holding time Sec | [3] Cooling rate ° C./sec | [4] Rapid cooling starting temperature ° C. | [4] Cooling rate ° C./sec |
|---|---|---|---|---|---|---|---|---|---|
| 26 | f | 500 | 1,200 | 10 | 800 | 120 | 10 | 700 | 28 |
| 27 | g | 500 | 1,200 | 10 | 900 | 120 | 10 | 700 | 28 |
| 28 | h | 500 | 1,200 | 10 | 850 | 120 | 10 | 700 | 28 |
| 29 | i | 500 | 1,200 | 10 | 850 | 120 | 10 | 700 | 28 |
| 30 | j | 500 | 1,200 | 10 | 940 | 120 | 10 | 700 | 28 |
| 31 | k | 500 | 1,200 | 10 | 850 | 120 | 10 | 700 | 28 |
| 32 | l | 500 | 1,200 | 10 | 850 | 120 | | 850 | 28 |
| 33 | m | 500 | 1,200 | 10 | 850 | 120 | | 850 | 28 |
| 34 | n | 500 | 1,200 | 10 | 900 | 120 | | 850 | 28 |
| 35 | o | 500 | 1,200 | 10 | 900 | 120 | | 850 | 28 |
| 36 | p | 500 | 1,200 | 10 | 850 | 120 | | 850 | 28 |
| 37 | q | 500 | 1,200 | 10 | 850 | 120 | 10 | 850 | 28 |
| 38 | q | — | — | 10 | 850 | 120 | 10 | 850 | 28 |
| 39 | r | 500 | 1,200 | 10 | 850 | 120 | 10 | 700 | 28 |
| 40 | s | 500 | 1,200 | 10 | 850 | 120 | 10 | 700 | 28 |
| 41 | t | 500 | 1,200 | 10 | 850 | 120 | 10 | 700 | 28 |
| 42 | u | 500 | 1,200 | 10 | 850 | 120 | 10 | 700 | 28 |
| 43 | v | 500 | 1,200 | 10 | 850 | 120 | 10 | 700 | 28 |
| 44 | w | 500 | 1,200 | 10 | 850 | 120 | 10 | 700 | 28 |
| 45 | x | 500 | 1,200 | 10 | 850 | 120 | 10 | 700 | 28 |
| 46 | y | 500 | 1,200 | 10 | 850 | 120 | 10 | 700 | 28 |
| 47 | z | 500 | 1,200 | 10 | 850 | 120 | 10 | 700 | 28 |

| No. | Heat treatment conditions: [5] Holding temperature ° C. | [5] Holding time Sec | [6] Cooling rate ° C./sec | [6] Cooling stopping temperature ° C. | [7] Holding time Sec | [8] Reheating temperature ° C. | [9] Holding time Sec | [10] Cooling rate ° C./sec |
|---|---|---|---|---|---|---|---|---|
| 26 | 400 | 50 | 30 | 200 | 50 | 400 | 300 | 10 |
| 27 | 400 | 50 | 30 | 200 | 50 | 400 | 300 | 10 |
| 28 | 400 | 50 | 30 | 200 | 50 | 400 | 300 | 10 |
| 29 | 200 | 50 | 30 | 200 | 50 | 450 | 300 | 10 |
| 30 | 400 | 50 | 30 | 200 | 50 | 400 | 300 | 10 |
| 31 | 400 | 50 | 30 | 200 | 50 | 400 | 300 | 10 |
| 32 | 400 | 50 | 30 | 200 | 50 | 400 | 300 | 10 |
| 33 | 400 | 50 | 30 | 200 | 50 | 400 | 300 | 10 |
| 34 | 400 | 50 | 30 | 200 | 50 | 400 | 300 | 10 |
| 35 | 400 | 50 | 30 | 200 | 50 | 400 | 300 | 10 |
| 36 | 400 | 50 | 30 | 200 | 50 | 400 | 300 | 10 |
| 37 | 400 | 50 | 30 | 200 | 50 | 400 | 300 | 10 |
| 38 | 400 | 50 | 30 | 200 | 50 | 400 | 300 | 10 |
| 39 | 400 | 50 | 30 | 200 | 50 | 400 | 300 | 10 |
| 40 | 400 | 50 | 30 | 200 | 50 | 400 | 300 | 10 |
| 41 | 400 | 50 | 30 | 200 | 50 | 400 | 300 | 10 |
| 42 | 400 | 50 | 30 | 200 | 50 | 400 | 300 | 10 |
| 43 | 400 | 50 | 30 | 200 | 50 | 400 | 300 | 10 |
| 44 | 400 | 50 | 30 | 200 | 50 | 400 | 300 | 10 |
| 45 | 400 | 50 | 30 | 200 | 50 | 400 | 300 | 10 |
| 46 | 400 | 50 | 30 | 200 | 50 | 400 | 300 | 10 |
| 47 | 400 | 50 | 30 | 200 | 50 | 400 | 300 | 10 |

2. Steel Structure and Amount of Solute Nitrogen

With respect to each sample, using the above-mentioned methods, the ferrite fraction, the total fraction of tempered martensite and tempered bainite (described as "tempered M/B" in Table 3-1 and Table 3-2), the amount of retained austenite (amount of retained λ), the MA average size, the average size of retained austenite (average grain size of retained λ), the ratio of retained austenite having a size of 1.5 μm or more to the total amount of retained austenite (described as "ratio of retained y having a size of 1.5 μm or more" in Table 3-1 and Table 3-2), and the amount of solute nitrogen were determined. In the measurement of the amount of retained austenite, a two-dimensional micro area X-ray diffraction apparatus (RINT-RAPID II) manufactured by Rigaku Corporation was used. The obtained results are shown in Table 3-1 and Table 3-2.

TABLE 3-1

| No. | Steel No. | Ferrite % | Tempered M/B % | Amount of retained γ % | Average size of MA μm | Average size of retained γ μm | Ratio of retained γ having size of 1.5 μm or more % | Amount of solute nitrogen % by mass |
|---|---|---|---|---|---|---|---|---|
| 1 | a | 0 | 72 | 17.4 | 0.53 | 0.81 | 3.10 | 0.0031 |
| 2 | a | 0 | 73 | 16.7 | 0.49 | 0.55 | 3.23 | 0.0029 |
| 3 | a | 0 | 72 | 17.0 | 0.51 | 0.62 | 3.08 | 0.0026 |
| 4 | a | 0 | 69 | 14.5 | 0.54 | 0.80 | 0.59 | 0.0011 |
| 5 | a | 0 | 69 | 16.7 | 1.34 | 0.92 | 2.88 | 0.0018 |
| 6 | a | 0 | 71 | 17.5 | 1.26 | 0.91 | 3.26 | 0.0010 |
| 7 | a | 0 | 67 | 16.2 | 0.52 | 0.71 | 0.73 | 0.0012 |
| 8 | a | 0 | 71 | 17.1 | 1.25 | 0.97 | 3.06 | 0.0019 |
| 9 | a | 0 | 70 | 16.5 | 0.55 | 0.80 | 0.72 | 0.0010 |
| 10 | a | 0 | 0 | 19.2 | 1.42 | 1.21 | 3.05 | 0.0011 |
| 11 | a | 31 | 49 | 16.4 | 0.52 | 0.73 | 2.35 | 0.0012 |
| 12 | a | 0 | 74 | 18.8 | 0.47 | 0.56 | 3.46 | 0.0015 |
| 13 | a | 0 | 85 | 5.2 | 0.50 | 0.57 | 2.13 | 0.0011 |
| 14 | a | 0 | 71 | 17.6 | 0.52 | 0.63 | 3.21 | 0.0012 |
| 15 | a | 0 | 70 | 17.2 | 0.52 | 0.59 | 2.83 | 0.0012 |
| 16 | a | 0 | 72 | 17.6 | 0.61 | 0.73 | 2.38 | 0.0013 |
| 17 | a | 24 | 59 | 13.5 | 0.59 | 0.78 | 2.26 | 0.0011 |
| 18 | a | 0 | 73 | 7.0 | 0.56 | 0.72 | 2.34 | 0.0014 |
| 19 | a | 0 | 63 | 7.6 | 0.51 | 0.59 | 2.95 | 0.0012 |
| 20 | a | 0 | 72 | 16.8 | 0.50 | 0.62 | 2.75 | 0.0013 |
| 21 | a | 0 | 74 | 17.8 | 0.43 | 0.58 | 3.19 | 0.0014 |
| 22 | b | 0 | 72 | 16.1 | 0.54 | 0.81 | 2.53 | 0.0011 |
| 23 | c | 0 | 71 | 18.6 | 0.48 | 0.70 | 2.61 | 0.0014 |
| 24 | d | 0 | 75 | 14.4 | 0.50 | 0.67 | 2.48 | 0.0012 |
| 25 | e | 0 | 77 | 8.2 | 0.54 | 0.84 | 0.72 | 0.0009 |

TABLE 3-2

| No. | Steel No. | Ferrite % | Tempered M/B % | Amount of retained γ % | Average size of MA μm | Average size of retained γ μm | Ratio of retained γ having size of 1.5 μm or more % | Amount of solute nitrogen % by mass |
|---|---|---|---|---|---|---|---|---|
| 26 | f | 0 | 79 | 9.1 | 0.50 | 0.65 | 0.68 | 0.0009 |
| 27 | g | 27 | 42 | 16.8 | 0.50 | 0.56 | 4.42 | 0.0012 |
| 28 | h | 0 | 77 | 9.3 | 0.53 | 0.57 | 3.97 | 0.0015 |
| 29 | i | 0 | 64 | 23.2 | 0.55 | 0.81 | 5.08 | 0.0019 |
| 30 | j | 0 | 71 | 23.4 | 1.33 | 0.98 | 2.21 | 0.0020 |
| 31 | k | 0 | 70 | 16.3 | 0.51 | 0.79 | 3.42 | 0.0012 |
| 32 | l | 0 | 71 | 16.2 | 0.48 | 0.57 | 3.85 | 0.0011 |
| 33 | m | 0 | 70 | 17.3 | 0.52 | 0.63 | 3.29 | 0.0013 |
| 34 | n | 0 | 71 | 16.9 | 0.50 | 0.73 | 4.01 | 0.0011 |
| 35 | o | 0 | 73 | 17.3 | 0.51 | 0.77 | 4.18 | 0.0013 |
| 36 | p | 0 | 71 | 17.3 | 0.49 | 0.67 | 3.97 | 0.0014 |
| 37 | q | 0 | 70 | 18.3 | 0.48 | 0.53 | 3.93 | 0.0030 |
| 38 | q | 0 | 70 | 18.6 | 0.46 | 0.49 | 3.93 | 0.0015 |
| 39 | r | 0 | 72 | 19.8 | 0.50 | 0.62 | 3.25 | 0.0015 |
| 40 | s | 0 | 71 | 19.7 | 0.49 | 0.55 | 3.14 | 0.0014 |
| 41 | t | 0 | 73 | 19.4 | 0.51 | 0.64 | 3.10 | 0.0015 |
| 42 | u | 0 | 71 | 17.6 | 0.42 | 0.46 | 2.93 | 0.0014 |
| 43 | v | 0 | 71 | 18.7 | 0.50 | 0.52 | 3.13 | 0.0014 |
| 44 | w | 0 | 71 | 17.4 | 0.42 | 0.47 | 2.97 | 0.0012 |
| 45 | x | 0 | 72 | 17.1 | 0.42 | 0.56 | 2.94 | 0.0013 |
| 46 | y | 0 | 72 | 18.6 | 0.54 | 0.73 | 3.34 | 0.0011 |
| 47 | z | 0 | 72 | 18.5 | 0.50 | 0.60 | 3.41 | 0.0013 |

3. Mechanical Properties

With respect to the thus obtained samples, using a tensile tester, YS, TS and EL were measured, and YR and TS×EL were calculated. Using the above-mentioned methods, the hole expansion ratio λ, the deep drawability LDR, and the cross tensile strength of a spot welded portion (SW cross tension) were determined. The obtained results are shown in Table 4-1 and Table 4-2.

TABLE 4-1

| No. | Steel No. | Properties | | | | | | | |
|---|---|---|---|---|---|---|---|---|---|
| | | YS MPa | TS MPa | YR | EL % | TS × EL MPa % | Hole expansion ratio λ % | Deep drawability LDR | SW cross tension kN |
| 1 | a | 964 | 1,187 | 0.81 | 19.6 | 23,212 | 26 | 2.05 | 7.3 |
| 2 | a | 964 | 1,190 | 0.81 | 18.8 | 22,398 | 25 | 2.05 | 7.2 |
| 3 | a | 970 | 1,193 | 0.81 | 19.2 | 22,969 | 24 | 2.06 | 7.1 |
| 4 | a | 1,074 | 1,288 | 0.83 | 16.4 | 21,124 | 46 | 1.87 | 6.9 |
| 5 | a | 959 | 1,201 | 0.80 | 18.8 | 22,600 | 14 | 2.05 | 6.8 |
| 6 | a | 988 | 1,207 | 0.82 | 19.1 | 22,990 | 13 | 2.06 | 6.6 |
| 7 | a | 1,073 | 1,300 | 0.82 | 16.6 | 21,625 | 48 | 1.89 | 7.3 |
| 8 | a | 981 | 1,210 | 0.81 | 19.3 | 23,325 | 15 | 2.06 | 6.5 |
| 9 | a | 996 | 1,202 | 0.83 | 18.6 | 22,376 | 44 | 1.92 | 7.0 |
| 10 | a | 765 | 971 | 0.79 | 18.1 | 17,611 | 15 | 2.05 | 6.7 |
| 11 | a | 624 | 941 | 0.66 | 21.8 | 20,514 | 12 | 2.05 | 6.5 |
| 12 | a | 997 | 1,187 | 0.84 | 19.9 | 23,613 | 59 | 2.11 | 8.2 |
| 13 | a | 908 | 1,083 | 0.84 | 13.0 | 14,072 | 69 | 2.06 | 7.8 |
| 14 | a | 992 | 1,198 | 0.83 | 19.8 | 23,670 | 57 | 2.10 | 8.3 |
| 15 | a | 1,007 | 1,211 | 0.83 | 19.7 | 23,882 | 60 | 2.11 | 9.1 |
| 16 | a | 1,000 | 1,200 | 0.83 | 19.2 | 23,074 | 63 | 2.10 | 8.8 |
| 17 | a | 609 | 967 | 0.63 | 22.4 | 21,661 | 13 | 2.05 | 6.6 |
| 18 | a | 881 | 1,078 | 0.82 | 15.7 | 16,945 | 58 | 2.05 | 6.7 |
| 19 | a | 1,094 | 1,323 | 0.83 | 13.5 | 17,798 | 42 | 2.08 | 6.7 |
| 20 | a | 1,002 | 1,197 | 0.84 | 19.3 | 23,108 | 59 | 2.12 | 8.5 |
| 21 | a | 967 | 1,190 | 0.81 | 19.6 | 23,307 | 52 | 2.11 | 8.2 |
| 22 | b | 996 | 1,231 | 0.81 | 18.8 | 23,143 | 62 | 2.10 | 9.2 |
| 23 | c | 1,001 | 1,206 | 0.83 | 19.5 | 23,546 | 54 | 2.10 | 8.6 |
| 24 | d | 967 | 1,215 | 0.80 | 19.2 | 23,328 | 56 | 2.10 | 8.4 |
| 25 | e | 845 | 1,023 | 0.83 | 16.5 | 16,933 | 68 | 1.81 | 10.0 |

TABLE 4-2

| No. | Steel No. | Properties | | | | | | | |
|---|---|---|---|---|---|---|---|---|---|
| | | YS MPa | TS MPa | YR | EL % | TS × EL MPa % | Hole expansion ratio λ % | Deep drawability LDR | SW cross tension kN |
| 26 | f | 860 | 1,042 | 0.83 | 14.8 | 15,369 | 65 | 1.87 | 6.2 |
| 27 | g | 631 | 965 | 0.65 | 23.4 | 22,581 | 12 | 2.06 | 9.9 |
| 28 | h | 951 | 1,200 | 0.79 | 15.2 | 18,197 | 46 | 2.07 | 8.6 |
| 29 | i | 1,227 | 1,488 | 0.83 | 14.2 | 21,094 | 44 | 2.13 | 1.9 |
| 30 | j | 1,105 | 1,383 | 0.80 | 16.4 | 22,681 | 16 | 2.06 | 6.0 |
| 31 | k | 1,002 | 1,204 | 0.83 | 19.2 | 23,109 | 57 | 2.10 | 8.5 |
| 32 | l | 991 | 1,214 | 0.82 | 19.0 | 23,066 | 61 | 2.11 | 8.3 |
| 33 | m | 1,001 | 1,206 | 0.83 | 19.5 | 23,525 | 54 | 2.10 | 9.1 |
| 34 | n | 1,008 | 1,199 | 0.84 | 19.3 | 23,148 | 59 | 2.12 | 8.5 |
| 35 | o | 978 | 1,211 | 0.81 | 19.6 | 23,764 | 55 | 2.10 | 8.4 |
| 36 | p | 987 | 1,210 | 0.82 | 19.4 | 23,471 | 54 | 2.12 | 8.6 |
| 37 | q | 1,005 | 1,202 | 0.84 | 19.8 | 23,774 | 24 | 2.05 | 9.1 |
| 38 | q | 1,005 | 1,200 | 0.84 | 19.7 | 23,606 | 51 | 2.10 | 8.0 |
| 39 | r | 982 | 1,198 | 0.82 | 20.2 | 24,262 | 51 | 2.11 | 8.4 |
| 40 | s | 978 | 1,190 | 0.82 | 20.2 | 24,037 | 53 | 2.13 | 8.1 |
| 41 | t | 976 | 1,195 | 0.82 | 20.0 | 23,946 | 51 | 2.12 | 8.2 |
| 42 | u | 1,023 | 1,228 | 0.83 | 19.1 | 23,500 | 52 | 2.10 | 8.2 |
| 43 | v | 996 | 1,215 | 0.82 | 19.8 | 24,037 | 52 | 2.10 | 8.1 |
| 44 | w | 994 | 1,232 | 0.81 | 19.1 | 23,563 | 56 | 2.11 | 8.1 |
| 45 | x | 1,002 | 1,237 | 0.81 | 19.5 | 24,091 | 55 | 2.12 | 8.7 |
| 46 | y | 980 | 1,197 | 0.82 | 19.5 | 23,332 | 61 | 2.10 | 8.7 |
| 47 | z | 1,003 | 1,203 | 0.83 | 19.8 | 23,820 | 56 | 2.11 | 8.3 |

4. Conclusion

All of samples Nos. 12, 14 to 16, 20 to 24, 31 to 36 and 38 to 47 that are samples of Examples satisfying the conditions of the embodiments of the present invention achieve 980 MPa or more of the tensile strength, 0.75 or more of the yield ratio, 20,000 MPa % or more of TS×EL, 2.05 or more of LDR, 30% or more of the hole expansion ratio, and 6 kN or more of the SW cross tension.

To the contrary, sample No. 1 exhibited large amount of solute nitrogen, thus failing to obtain sufficient hole expansion ratio since pre-annealing was not performed.

Sample No. 2 exhibited large amount of solute nitrogen, thus failing to obtain sufficient hole expansion ratio because of low pre-annealing temperature, and sample No. 3 exhibited a large amount of solute nitrogen, thus failing to obtain sufficient hole expansion ratio because of short pre-annealing time.

Sample No. 4 exhibited insufficient amount of retained austenite having a size of 1.5 μm or more, thus failing to obtain sufficient deep drawability since retention was not performed at a temperature in a range of 300° C. to 500° C. after austenitization.

Sample No. 5 exhibited excessive average size of MA, thus failing to obtain sufficient hole expansion ratio because of long retention time at a temperature in a range of 300° C. to 500° C. after austenitization.

Sample No. 6 exhibited excessive average size of MA, thus failing to obtain sufficient hole expansion ratio because of low average cooling rate from the second cooling starting temperature ("[5] Holding Temperature" shown in Table 2-1 and Table 2-2) to the cooling stopping temperature.

Sample No. 7 exhibited insufficient amount of retained austenite having a size of 1.5 μm or more, thus failing to obtain sufficient deep drawability because of short holding time at a temperature in a range of 300° C. to 500° C. after austenitization.

Sample No. 8 exhibited excessive average size of MA, thus failing to obtain sufficient hole expansion ratio since retention was performed at a temperature higher than a temperature in a range of 300° C. to 500° C. after austenitization.

Sample No. 9 exhibited insufficient amount of retained austenite having a size of 1.5 μm or more, thus failing to obtain sufficient deep drawability since retention was performed at a temperature lower than a temperature in a range of 300° C. to 500° C. after austenitization.

Sample No. 10 exhibited insufficient total amount of tempered martensite and tempered bainite and excessive average size of retained austenite since stopping at a cooling stopping temperature between 100° C. or higher and lower than 300° C. ([7] of FIG. 1) and reheating ([8] to [10] of FIG. 1) were not performed. Because of long retention time at a temperature in a range of 300° C. to 500° C. after austenitization, the average size of MA was excessive. As a result, the sufficient tensile strength, TS×EL, and the hole expansion ratio could not be obtained. It is considered that the amount of retained austenite in the structure satisfied the amount defined in the present application since coarse MA (mixed structure of retained austenite and martensite) increased.

Sample No. 11 exhibited excessive amount of ferrite and insufficient total amount of tempered martensite and tempered bainite, thus failing to obtain sufficient tensile strength, yield ratio and hole expansion ratio because of low heating temperature for austenitization.

Sample No. 13 exhibited small amount of retained austenite, thus failing to obtain sufficient value of TS×EL since the cooling stopping temperature is lower than a temperature in a range of 100° C. or higher and lower than 300° C.

Sample No. 17 exhibited excessive amount of ferrite and insufficient total amount of tempered martensite and tempered bainite because of low cooling rate from the rapid cooling starting temperature to the retention starting temperature ("[5] Holding Temperature" of Table 2-1 and Table 2-2). As a result, sufficient tensile strength, yield ratio and hole expansion ratio could not be obtained.

Sample No. 18 exhibited small amount of retained austenite, thus failing to obtain sufficient TS×EL since the reheating temperature is higher than a temperature in a range of 300° C. to 500° C.

Sample No. 19 exhibited small amount of retained austenite, thus failing to obtain sufficient TS×EL since the reheating temperature is lower than a temperature in a range of 300° C. to 500° C.

Sample No. 25 exhibited insufficient amount of retained austenite and insufficient amount of retained austenite having a size of 1.5 μm or more, thus failing to obtain sufficient TS×EL and deep drawability because of small amount of C.

Sample No. 26 exhibited insufficient amount of retained austenite having a size of 1.5 μm or more, thus failing to obtain sufficient deep drawability because of large amount of Mn. It is considered that bainite transformation was suppressed, and thus coarse retained austenite was not formed (that is, only fine retained austenite was formed) because of large amount of Mn, as a result, the amount of retained austenite was insufficient and TS×EL was degraded.

Sample No. 27 exhibited excessive amount of ferrite because of small amount of Mn. The total amount of tempered martensite and tempered bainite was insufficient because of large amount of ferrite. As a result, sufficient tensile strength, yield ratio and hole expansion property could not be obtained.

Sample No. 28 exhibited insufficient amount of retained austenite, thus failing to obtain sufficient TS×EL because of small amount of Si+Al.

Sample No. 29 failed to obtain sufficient SW cross tensile strength because of excessive amount of C.

Sample No. 30 exhibited excessive average size of MA, thus failing to obtain sufficient hole expansion ratio because of excessive amount of Si+Al.

Sample No. 37 exhibited large amount of solute nitrogen, thus failing to obtain sufficient hole expansion ratio since pre-annealing was not performed.

The contents disclosed in the present specification include the following aspects.

Aspect 1:

A high-strength sheet containing:

C: 0.15% by mass to 0.35% by mass, a total of Si and Al: 0.5% by mass to 3.0% by mass, Al: 0.01% by mass or more, N: 0.01% by mass or less, Mn: 1.0% by mass to 4.0% by mass, P: 0.05% by mass or less, and S: 0.01% by mass or less, with the balance being Fe and inevitable impurities, wherein the steel structure satisfies that:

a ferrite fraction is 5% or less, a total fraction of tempered martensite and tempered bainite is 60% or more, an amount of retained austenite is 10% or more, MA has an average size of 1.0 μm or less, retained austenite has an average size of 1.0 μm or less, retained austenite having a size of 1.5 μm or more accounts for 2% or more of the total amount of retained austenite, and an amount of solute nitrogen in a steel sheet is 0.002% by mass or less.

Aspect 2:

The high-strength sheet according to aspect 1, in which the amount of C is 0.30% by mass or less.

Aspect 3:

The high-strength sheet according to aspect 1 or 2, in which the amount of Al is less than 0.10% by mass.

Aspect 4:

The high-strength sheet according to any one of aspects 1 to 3, further containing one or more of Cu, Ni, Mo, Cr and B, and a total content of Cu, Ni, Mo, Cr and B is 1.0% by mass or less.

Aspect 5:

The high-strength sheet according to any one of aspects 1 to 4, further containing one or more of Ti, V, Nb, Mo, Zr and Hf, and a total content of Ti, V, Nb, Mo, Zr and Hf is 0.2% by mass or less.

Aspect 6:

The high-strength sheet according to any one of aspects 1 to 5, further containing one or more of Ca, Mg and REM, and a total content of Ca, Mg and REM is 0.01% by mass or less.

Aspect 7:

A method for manufacturing a high-strength sheet, including:

preparing a hot-rolled steel sheet with the composition according to any one of aspects 1 to 6;

pre-annealing the hot-rolled steel sheet at a temperature of 450° C. to an $Ae_1$ point for 10 minutes to 30 hours;

after pre-annealing, subjecting the pre-annealed steel sheet to cold-rolling to obtain a cold-rolled steel sheet;

heating the cold-rolled steel sheet to a temperature of an $Ac_3$ point or higher to austenitize the cold-rolled steel sheet;

after the austenitization, cooling the austenitized steel sheet between 650° C. and 500° C. at an average cooling rate of 15° C./sec or more and less than 200° C./sec, and then retaining at a temperature in a range of 300° C. to 500° C. at a cooling rate of 10° C./sec or less for 10 seconds or more and less than 300 seconds;

after the retention, cooling the steel sheet from a temperature of 300° C. or higher to a cooling stopping temperature between 100° C. or higher and lower than 300° C. at an average cooling rate of 10° C./sec or more; and heating the steel sheet from the cooling stopping temperature to a reheating temperature in a range of 300° C. to 500° C.

Aspect 8:

The manufacturing method according to aspect 7, in which the retention includes holding at a constant temperature in a range of 300° C. to 500° C.

The application claims priority to Japanese Patent Application No. 2017-108340 filed on May 31, 2017. Japanese Patent Application No. 2017-108340 is incorporated herein by reference.

The invention claim is:

1. A high-strength sheet, comprising, as mass percent:

Fe;

C in a range of from more than 0.25 to 0.35%;

a total of Si and Al in a range of from 0.5 to 3.0%;

Al in at least 0.01%;

N in 0.01% or less;

Mn in a range of from 1.0 to 4.0%;

P in 0.05% or less; and

S in 0.01% or less;

wherein the high-strength sheet comprises a steel structure, wherein, in the steel structure, a ferrite fraction is 5% or less, wherein, in the steel structure, a total fraction of tempered martensite and tempered bainite is 60% or more, wherein, in the steel structure, an amount of retained austenite is 10% or more, wherein, in the steel structure, a martensite-austenite constituent has an average size of 1.0 μm or less, wherein, in the steel structure, the retained austenite has an average size of 1.0 μm or less, wherein, in the steel structure, the retained austenite having a size of 1.5 μm or more accounts for 2% or more of a total amount of the retained austenite, and wherein, in the steel structure, an amount of solute nitrogen in the high-strength sheet is 0.002% by mass or less.

2. The sheet of claim 1, satisfying any one or more of (a) to (e):

(a) comprising the C in a range of from more than 0.25 to 0.30% by mass;

(b) comprising the Al in a range of from 0.01 to 0.10% by mass;

(c) further comprising Cu, Ni, Mo, Cr, and/or B, and a total content of Cu, Ni, Mo, Cr, and B is 1.0% by mass or less, (d) further comprising Ti, V, Nb, Mo, Zr, and/or Hf, and a total content of Ti, V, Nb, Mo, Zr, and Hf is 0.2% by mass or less, and (e) further comprising Ca, Mg, and/or REM, and a total content of Ca, Mg, and REM is 0.01% by mass or less.

3. A method for manufacturing the high-strength sheet of claim 1, the method comprising:

preparing a hot-rolled steel sheet comprising, as mass percent:

Fe;

C in a range of from more than 0.25 to 0.35%;

a total of Si and Al in a range of from 0.5 to 3.0%;

Al in at least 0.01%;

N in 0.01% or less;

Mn in a range of from 1.0 to 4.0%;

P in 0.05% or less; and

S in 0.01% or less;

pre-annealing the hot-rolled steel sheet at a temperature of 450° C. to an Ae1 point for 10 minutes to 30 hours, thereby obtaining a pre-annealed steel sheet;

after pre-annealing, subjecting the pre-annealed steel sheet to cold-rolling to obtain a cold-rolled steel sheet;

heating the cold-rolled steel sheet to a temperature of an Ac3 point or higher to austenitize the cold-rolled steel sheet, thereby obtaining an austenitized steel sheet;

after the austenitization heating, cooling the austenitized steel sheet between 650° C. and 500° C. at an average cooling rate of 15° C./sec or more and less than 200'C/sec, and then retaining at a temperature in a range of 300° C. to 500° C. at a cooling rate of 10° C./sec or less for 10 seconds or more and less than 300 seconds;

after the retaining, cooling the austenitized steel sheet from a temperature of 300° C. or higher to a cooling stopping temperature between 100° C. or higher and lower than 300° C. at an average cooling rate of 10° C./sec or more; and heating the steel sheet from the cooling stopping temperature to a reheating temperature in a range of from 300° C. to 500° C.

4. The method of claim 3, wherein the retaining comprises holding at a constant temperature in a range of from 300° C. to 500° C.

5. The method of claim 3, wherein the hot-rolled steel sheet satisfies any one or more of (a) to (e):

(a) comprising the C is present in a range of from more than 0.25 to 0.30% by mass, (b) comprising the Al is present in a range of from 0.01 to less than 0.10% by mass, (c) further comprising Cu, Ni, Mo, Cr, and/or B, and a total content of Cu, Ni, Mo, Cr, and B is 1.0% by mass or less, (d) further comprising Ti, V, Nb, Mo, Zr, and/or Hf, and a total content of Ti, V Nb, Mo, Zr, and Hf is 0.2% by mass or less, and (e) further comprising Ca, Mg, and/or REM, and a total content of Ca, Mg, and REM is 0.01% by mass or less.

6. The method of claim 4, wherein the hot-rolled steel sheet satisfies any one or more of (a) to (e):

(a) comprising the C is present in a range of from more than 0.25 to 0.30% by mass, (b) comprising less than 0.10% by mass of Al, (c) further comprising Cu, Ni, Mo, Cr, and/or B, and a total content of Cu, Ni, Mo, Cr, and B is 1.0% by mass or less, (d) further comprising Ti, V, Nb, Mo, Zr, and/or Hf, and a total content of Ti, V, Nb, Mo, Zr, and Hf is 0.2% by mass or less, and (e) further comprising Ca, Mg, and/or REM, and a total content of Ca, Mg, and REM is 0.01% by mass or less.

7. The sheet of claim 1, comprising the C in a range of from more than 0.25 to 0.30%.

8. The sheet of claim 1, comprising the Al in a range of from more than 0.01 to less than 0.10%.

9. The sheet of claim 7, comprising the Al in a range of from more than 0.01 to less than 0.10%.

10. The sheet of claim 1, further comprising (c) Cu, Ni, Mo, Cr, and/or B, wherein a total content of Cu, Ni, Mo, Cr, and B is 1.0% by mass or less.

11. The sheet of claim 7, further comprising (c) Cu, Ni, Mo, Cr, and/or B, wherein a total content of Cu Ni, Mo, Cr, and B is 1.0% by mass or less.

12. The sheet of claim 8, further comprising (c) Cu, Ni, Mo, Cr, and/or B, wherein a total content of Cu, Ni, Mo, Cr, and B is 1.0% by mass or less.

13. The sheet of claim 1, further comprising (d) Ti, V, Nb, Mo, Zr, and/or Hf, wherein a total content of Ti, V, Nb, Mo, Zr, and Hf is 0.2% by mass or less.

14. The sheet of claim 1, further comprising (e) Ca, Mg, and/or REM, wherein a total content of Ca, Mg, and REM is 0.01% by mass or less.

15. The sheet of claim 1, wherein the C is present in a range of from 0.26 to 0.35% by mass.

16. The sheet of claim 1, wherein the C is present in a range of from 0.27 to 0.35% by mass.

17. The sheet of claim 1, wherein the C is present in a range of from 0.28 to 0.35% by mass.

18. The sheet of claim 1, comprising no more than 1.10% by mass of the Si.

19. The sheet of claim 1, wherein, in the steel structure, the amount of the retained austenite is 15% or more.

20. The sheet of claim 1, wherein the C is present in a range of from 0.26 to 0.35% by mass, and wherein, in the steel structure, the amount of the retained austenite is 15% or more.

* * * * *